US007500908B2

(12) United States Patent
Achy et al.

(10) Patent No.: US 7,500,908 B2
(45) Date of Patent: Mar. 10, 2009

(54) PNEUMATIC BLOCKING SUPPORT FOR AN OPTICAL LENS

(75) Inventors: Armand Achy, Noisy le Grand (FR); Alain Chansavoir, Montmorency (FR); Jean-François Belly, Choisy le Roi (FR)

(73) Assignee: Essilor International, Charenton-le-Pont (FR)

( * ) Notice: Subject to any disclaimer, the term of this patent is extended or adjusted under 35 U.S.C. 154(b) by 0 days.

(21) Appl. No.: 10/582,098

(22) PCT Filed: Nov. 4, 2004

(86) PCT No.: PCT/FR2004/002831

§ 371 (c)(1),
(2), (4) Date: Aug. 8, 2006

(87) PCT Pub. No.: WO2005/065886

PCT Pub. Date: Jul. 21, 2005

(65) Prior Publication Data

US 2007/0105490 A1 May 10, 2007

(30) Foreign Application Priority Data

Dec. 10, 2003 (FR) ..... 03 14468

(51) Int. Cl.
*B24B 7/00* (2006.01)

(52) U.S. Cl. ..... 451/390; 451/398

(58) Field of Classification Search ..... 451/390, 451/398, 388, 384
See application file for complete search history.

(56) References Cited

U.S. PATENT DOCUMENTS

| | | | | |
|---|---|---|---|---|
| 3,460,928 | A * | 8/1969 | Casko | 65/39 |
| 3,794,314 | A | 2/1974 | Coburn et al. | |
| 6,913,356 | B2 * | 7/2005 | Belly et al. | 451/398 |

FOREIGN PATENT DOCUMENTS

| | | |
|---|---|---|
| EP | 0 897 777 | 2/1999 |
| EP | 1 338 382 | 8/2003 |

* cited by examiner

*Primary Examiner*—Maurina Rachuba
(74) *Attorney, Agent, or Firm*—Young & Thompson

(57) ABSTRACT

The pneumatic blocking support which is used to block an optical lens (200) on a machine or device has means (3) for fixing it on a corresponding element of the machine or device. The blocking means comprise a central cavity (8) and a joint (9) having at least one annular part (9) against which the lens rests in order to define a depression chamber (11) with said cavity and joint. The blocking elements include stop members (10) which are created in order to provide the optical lens with a rigid seat after the elastic compression of the joint.

15 Claims, 2 Drawing Sheets

Fig.5
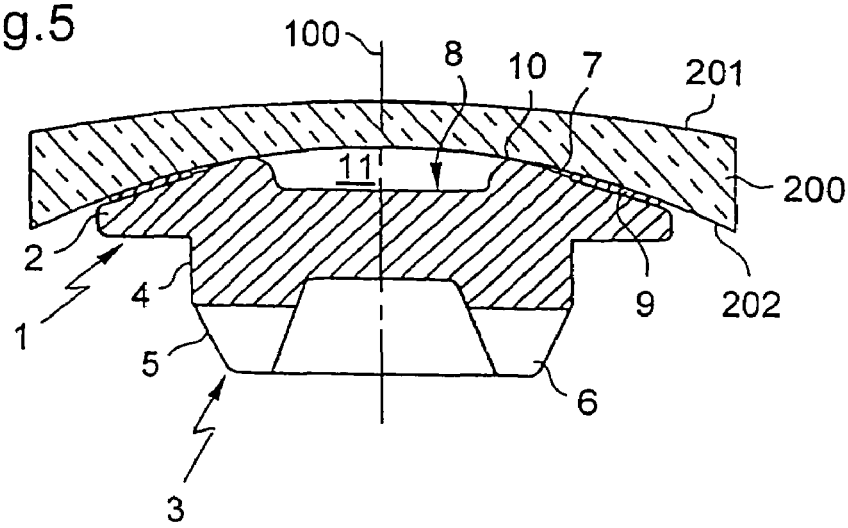
Fig.6
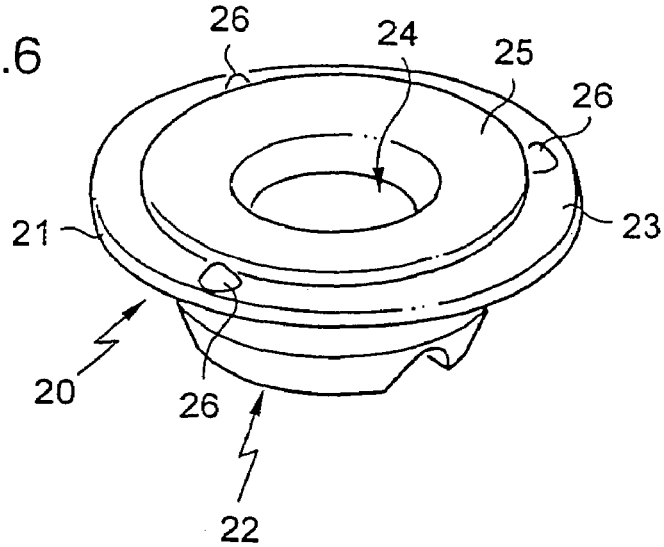
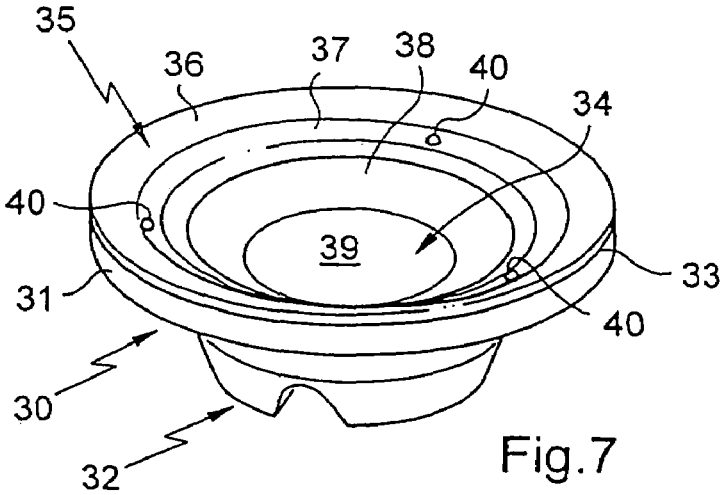
Fig.7

PNEUMATIC BLOCKING SUPPORT FOR AN OPTICAL LENS

TECHNICAL FIELD TO WHICH THE INVENTION RELATES

The present invention relates in general to fabricating optical lenses such as ophthalmological lenses, and/or lenses for sunglasses, objective lenses, etc. The invention relates in particular to blocking such a lens while it is being surfaced or inspected, and for this purpose it relates to a pneumatic blocking support for fixing on the nose of one or more machine tools or measurement or inspection devices in order to block the lens or a semi-finished blank of said lens on such a machine or device.

TECHNOLOGICAL BACKGROUND

The process for fabricating optical lenses, and more particularly corrective ophthalmological lenses, requires particularly high levels of care and precision. It generally comprises two main steps. Initially a semi-finished lens, also referred to as an optical blank or preform, is obtained by molding the synthetic or inorganic material that has been selected to constitute the basic substrate of the lens. Thereafter, the molded semi-finished lens is surfaced on one and/or both of its optically-useful main faces in order to satisfy the geometrical model and the prescribed correction. Because of the exacting requirements in terms of precision and roughness to which lenses are subjected, this surfacing operation is subdivided into a plurality of substeps associated with a corresponding number of specific workstations, so it becomes necessary to organize the transfer of the lens being surfaced from one station to another. Thus, for surfacing each of the faces of the lens, there are generally to be found a machining station that serves both to blank out and to finish by using two distinct tools, and a polishing station, possibly preceded by a smoothing station. Between these stations, and after them, there may be other stations for working on or inspecting the lens, for example an etching station, a station for inspecting shape or appearance, etc.

One of the more specific problems encountered during this process of surfacing the lens lies in assembling the lens on each station in a position that is precise and well-controlled. This repeated intermediate operation of taking hold of the part again and again, commonly known as "blocking" the lens, is particularly difficult and expensive and often leads to imprecise positioning of a kind that can significantly degrade the optical quality of the finished lens. Such blocking of the lens suffers from two constraints that are cumulative and antagonistic.

Firstly, the lens, which is constituted of transparent synthetic or inorganic material that has not yet been varnished, is relatively fragile and must be protected from any marking or cracking, particularly on that one of its two faces that has been finished while work is taking place on its other face. The risk of marking is particularly pronounced with synthetic materials.

In addition, and above all, the lens must be positioned on each station concerned in a manner that is very precise, so that it has a known and stable three-dimensional orientation in a determined frame of reference of the station in question. This constraint concerning geometrical stability of the blocking is particularly awkward and difficult to comply with when fabricating lenses having surfaces that are complex, such as progressive or personalized lenses that do not present circular symmetry. It will be understood that the surfacing of such lenses is accompanied by variations in cutting forces on gradients that are steep, and as a result it leads to deformation, accompanied by relative geometrical instability of the blocking of the lens.

Several ways are known for "blocking" a semi-finished lens or blank in order to mount it and rotate it on machine tools or measuring devices of different workstations, and in particular of surfacing stations. Traditionally, a blocking support is used, sometimes also referred to as a grip block or chuck, possessing firstly blocking means for receiving and holding the lens via one of its main faces, and secondly means for securing the support on the nose of various machine tools or measurement and inspection devices so as to provide blocking of the lens on the machine or device, possibly accompanied by the lens being driven in rotation.

The main difficulty lies in the way in which the lens is blocked on the support, given the above-mentioned constraints.

The method that is in most widespread use at present, because of its geometrical precision, consists in forming and securing a metal block on one of the faces of the lens by casting thereon a molten alloy having a low melting temperature, the metal block constituting the blocking support and presenting means enabling it to be secured to the noses of the machine tools in the various workstations involved. That method generally gives satisfaction in terms of precision and stability, but it presents several drawbacks economically and environmentally that make it necessary to seek alternative blocking means. The low melting point alloys used are relatively expensive and should be considered as pollutants that are dangerous for the environment, such that it is necessary both for economic reasons and for ever-increasing environmental constraints, to organize meticulous recycling thereof. However even with efficient recycling, it is not possible to avoid loosing alloy by evaporation during melting. Furthermore, because of the relative complexity of the operation and because of its cost, in particular given the above-mentioned environmental aspects, it is common practice to keep the lens blocked on the same support throughout the process, the assembly constituted by the lens and its support being transferred from station to station. Unfortunately, the assembly is relatively bulky, such that handling it, transporting it, and storing it all lead to additional logistics costs. Furthermore, for technical reasons, there also exists a minimum length of time that must elapse before a lens associated with its holding block can be fitted to a machining station (about 15 minutes), and a maximum length of time beyond which machining can no longer be performed (about 24 hours); these times thus put constraints on the work flows of said lenses. In addition, in the event of prolonged storage or waiting between two operations, it is excessively expensive to accommodate holding blocks in progress in quantities equivalent to the quantities of lenses in progress.

That is why it is sometimes necessary between two operations to release a lens from its initial support in order to transfer it, store it, or transport it more easily. When the process restarts, it is necessary to associate the lens with a new holding block, with the practical difficulties that stem therefrom not only in terms of casting the low-melting point alloy and recycling it, but also in terms of achieving complete geometrical control over such a restarted part, and the associated extra costs.

In order to avoid using a molten metal alloy, proposals have been made to use a wax, for example, to bond a lens to a corresponding face of the blocking support that has approximately the same curvature. However that solution, like using a block of fusible metal, leads to practical difficulties relating to release, i.e. separating the lens from the support, and to cleaning the lens, with the environmental repercussions that stem therefrom. Above all, the precision and the stability of the bonding between the lens and the support can turn out to be insufficient. The shape of the layer of adhesive or wax interposed between the lens and the support includes a random contribution, or is in any event difficult to control and can suffer from deformation in compression and in twisting during surfacing operations under the effect of stresses generated by the surfacing tool.

Finally, lens blocking systems have been proposed that rely on pneumatic suction. Such systems make use of a pneumatic chuck or grip block that, in order to form a kind of control suction cup, presents a cavity surrounded by an annular gasket against which the preform is pressed in order to co-operate with the cavity and the gasket to define a chamber in which suction is established. The suction may be created either in a vacuum vessel that for the blocking operation contains both the lens and the grip block, or else by means of a vacuum pump connected to the cavity in the block via a pneumatic valve.

That solution of pneumatic blocking, also referred as vacuum blocking, does not present the same economic and environmental drawbacks as the above-described solutions involving blocks that are cast or bonded by adhesive. Implementing the vacuum solution is particularly quick and simple both during blocking and during release, and no chemical consumable is involved. Nevertheless, in spite of its considerable advantages, that type of blocking is little used in practice. It is found to be lacking in the precision and the stability with which the lens is secured, to an extent that is analogous to that which is observed when using supports with adhesive. The solution is found to be particularly difficult to implement with surfaces that are complex (i.e. not spherical or toroidal) against which the elastically-compressible gasket does not press in a manner that is sufficiently precise and stable. It would indeed be possible to increase the stiffness of the compressibility of the gasket, but that would be to the detriment of its coefficient of friction and would lead to a reduction in the torque that can be transmitted when rotating the lens, unless the pressure in the suction chamber is reduced so as to increase the magnitude of the suction effect exerted by the support on the lens, but that would run the risk of deforming the lens. It has also been found that insufficient torque transmission runs the risk of slip, in particular while a lens being processed is in rotation. Such slip is liable to spoil the final positioning of the lens in front of the user's eyes, which is particularly harmful in terms of the user's visual comfort, particularly with progressive ophthalmological lenses.

U.S. Pat. No. 3,794,314 describes a pneumatic blocking support for blocking an optical lens on a machine or device, the support possessing firstly blocking means for receiving and holding one face of the optical lens, and secondly means enabling it to be secured to a corresponding member of the machine or device, said blocking means comprising a central cavity and a gasket having at least one annular portion against which the lens is pressed in order to co-operate with said cavity and said gasket to define a suction chamber, the blocking means including abutment means arranged to provide the optical lens with a seat that is rigid once the gasket has deformed elastically. However, in that support, the gasket is arranged to deform in bending and therefore acts like a lip seal.

That arrangement does not resolve all of the above-mentioned drawbacks. It suffers from three major drawbacks. Firstly it limits the contact area between the gasket and the lens, which presses solely against the free edge (inner edge) of the gasket. That narrow contact area tends to reduce the maximum torque that can be transmitted, so the risk of slip remains. Secondly, it does not make it easier to find a satisfactory compromise between stiffness and coefficient of friction, since its work in bending tends to impose high bending stiffness, whereas the desire for a high coefficient of friction tends on the contrary to look for an elastomer with limited stiffness. Torque transmission is therefore difficult to increase by selecting an appropriate material. Thirdly, working in bending leads to the elastomer wearing quickly, particularly when the elastomer possesses high stiffness.

OBJECT OF THE INVENTION

The object of the present invention is to provide an improvement to the pneumatic blocking solution, which improvement satisfies the requirements of precision, stability, and torque transmission.

For this purpose, the invention provides a support for pneumatically blocking an optical lens on a machine or a device, the support possessing firstly blocking means for receiving and holding one face of the optical lens, and secondly coupling means for fastening the block on a corresponding member of the machine or device, said blocking means including a central cavity and possessing a gasket possessing at least one annular portion against which the lens is brought to bear in order to co-operate with said cavity and said gasket to define a suction chamber, the blocking means comprising abutment means arranged to provide the optical lens with a rigid seat after the gasket has deformed elastically, wherein, in order to bring the lens into abutment, the gasket deforms in compression.

The rigidity of the seat of the lens on the support as conferred by the abutment means, which means form a sheet for the lens, thus ensures the stability and the precision for the geometrical positioning of the lens on its support. The geometry of the blocking of the lens is therefore not altered by the forces generated by the surfacing tools. In addition, the rigid seat provided by the abutment means enables positioning of the lens in the event of release and reblocking to be repetitive and of geometry that is constant, or at least that can be determined. Above all, this arrangement makes it possible to select the stiffness of the gasket appropriately and also to obtain a relatively large contact area between the gasket and the lens. These two parameters encourage obtaining high torque transmission without that requiring the lens to be pressed too hard against the rigid abutment means of the support. This avoids any untimely marking of blocked lenses (which are known to be particularly fragile on the surface, particularly for lenses made of synthetic material (cf. the introduction to the description of this application)), but without requiring mechanical indexing means to be implemented.

According to an advantageous characteristic of the invention, the gasket prevents the optical lens from turning solely by means of friction against the corresponding face of said element, and to the exclusion of any mechanical indexing means. Because of the existence of abutment means combined with the gasket working in compression, it is possible to decide to make the gasket out of a material that is relatively flexible, presenting a coefficient of friction that is high and thus making it possible to obtain sufficient torque transmission, but without that requiring the lens to be pressed too strongly against the support. This avoids any untimely marking of the lens and also avoids implementing mechanical indexing means. In order to increase the friction area, it is then advantageous to make provision for the gasket to present a flat shape, preferably having width that is at least three times greater than its thickness.

In practice, the abutment means may be made for example in the form of an annular bearing member or in the form of three spot bearing members that are not in alignment so as to form a tripod support.

DETAILED DESCRIPTION OF AN EMBODIMENT

Other characteristics and advantages of the invention appear on reading the following description of three particular embodiments, given as non-limiting examples.

Reference is made to the accompanying drawings, in which:

FIG. 5 is a view analogous to FIG. 3, after the lens has been blocked by suction;

FIG. 6 is a perspective view of a pneumatic blocking support in a second embodiment of the invention; and FIG. 7 is a perspective view of a pneumatic blocking support in a third embodiment of the invention.

Figure 1:
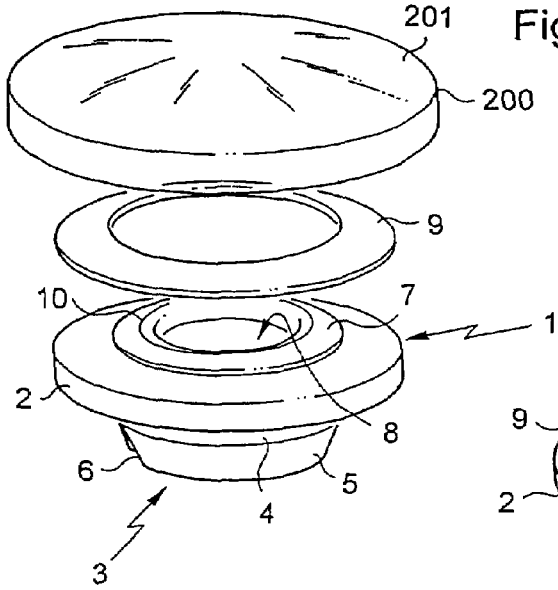
FIG. 1 is an overall exploded perspective view of a pneumatic blocking support in a first embodiment of the invention.
Figure 2:
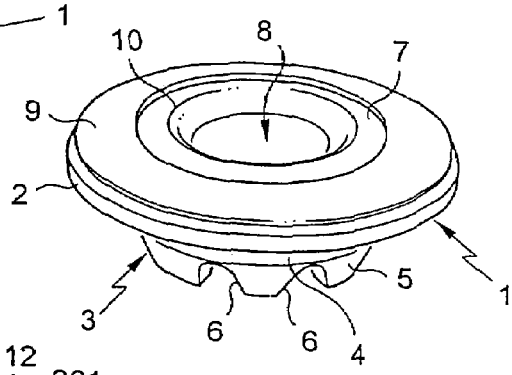
FIG. 2 is a perspective view of the FIG. 1 support when assembled.

With reference to FIGS. 1 to 5, there is described a first embodiment of a support capable of using pneumatic action to block an optical lens 200, specifically an ophthalmological lens for spectacles, on a machine tool or a measurement device (not shown).

The support comprises a block 1 that is generally of circular symmetry about a central axis 100. The block 1 comprises two main portions: a plate 2 for receiving the lens 200 that is to be blocked, and projecting from the plate, coupling means 3 for securing the support to the nose of a machine tool or a measurement device.

The coupling means 3 are of conventional type and are themselves well known to the person skilled in the art; there is therefore no need to describe their structure or their operation in detail herein. It suffices to mention that, as shown in the figures, these means are in the form of a sleeve on an axis 100, the sleeve comprising two segments, a cylindrical segment adjacent to the plate and referenced 4, and another segment that is conical and referenced 5. The end of the conical segment 5 is provided at its tip with indexing notches 6.

The support also possesses blocking means serving to receive and hold the lens 200 via its main face opposite from the face that is to be surfaced. These blocking means are arranged on a top face 7 of the plate 3. In the example shown, the lens 200 is to be blocked so as to enable its convex face 201 to be surfaced, so it is therefore necessary to hold the lens 200 via its concave face 202. For this purpose, the reception face 7 of the plate 2 is generally convex and specifically is almost conical in shape.

The blocking means comprise firstly a central cavity 8 and an annular gasket 9. The central cavity 8 is set back from the reception face 7 of the plate 2 so as to form a kind of crater therein. The annular gasket 9 is fitted on the plate 3 and projects from the reception face 7 thereof.

Figure 4:
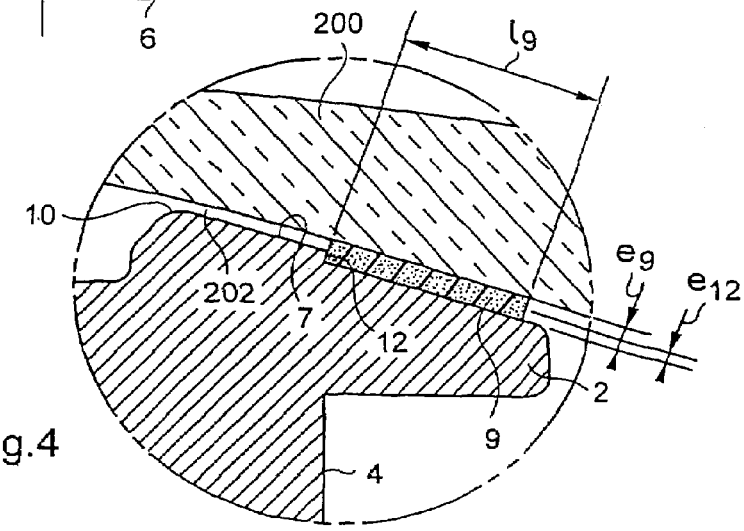
FIG. 4 is a detail view showing zone IV of FIG. 3.

The gasket 9 is in the form of a flat ring, having a radial dimension, i.e. a width that is referenced $l_9$ in FIG. 4, that is at least three times greater than its thickness $e_9$. In the example shown, the following values apply: $l_9$=10 millimeters (mm) (with an outside diameter of 63 mm and an inside diameter of 43 mm), and $e_9$=1.2 mm.

The blocking means further comprise abutment means arranged to form a stable and precise seat for receiving the lens 200, as explained better below. More precisely, in the first embodiment shown in FIGS. 1 to 5, these abutment means are in the form of an annular bead 10 that is circularly symmetrical about the axis 100. This annular bead is constituted by a circular ridge about the axis 100 adjacent to the central cavity 8 and formed at the top of the flank thereof. In order to avoid marking the face 202 of the lens 200, it is preferable for this ridge or bead to present no sharp edges, but on the contrary to present a surface that is continuous to the second order.

Outside this abutment bead, the reception face 7 presents a setback 12 with the inside edge of the gasket 9 being engaged thereagainst, thus forming a housing for holding the gasket 9 on the axis 100. As can be seen more clearly in FIG. 4, the setback 12 presents a depth $e_{12}$ that is clearly less than the thickness $e_9$ of the gasket 9, such that the gasket 9 projects clearly from the reception face 7. In the example shown, the following values apply: $e_{12}$=0.5 mm and $e_9$=1.2 mm. The gasket 9 thus projects from the reception face 7 by 0.7 mm.

The block 1 is made as a single molding of a rigid material such as a metal or a rigid plastics material. Only the gasket 9, e.g. made of rubber, constitutes a separate part fitted to the block.

Figure 3:
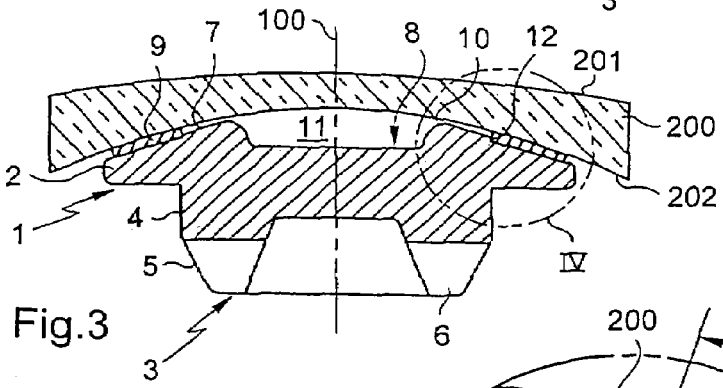
FIG. 3 is an axial section view of the support of FIGS. 1 and 2, on which there rests a lens prior to being blocked by means of suction.

In operation, as shown in FIG. 3, the lens 200 is initially pressed via its concave face 202 against the gasket 9 so as to co-operate with the cavity 8 and the gasket 9 to define a suction chamber 11. Relative suction is then established inside the chamber 11 so as to block the lens 200 by the suction-cup effect. The suction can be created, in conventional manner, either in a vacuum vessel containing the support and the lens for the blocking operation, or else under the effect of a vacuum pump connected to the chamber 11 via an opening (not shown) formed through the block 1 and fitted with a pneumatic valve (not shown).

The magnitude of the suction should be the result of a compromise between strength of blocking and preserving the optical integrity of the concave face 202 of the lens. During testing, satisfactory results have been obtained using suction of about −0.9 bars.

Under the effect of the suction as generated in this way, the gasket 9 is observed to compress elastically until the concave face 202 of the lens 200 comes into contact with the bead 10. This bead forming an abutment and seat provides the lens 200 with a seat that is rigid, precise, and stable, holding, i.e. blocking, the lens in a position that is determined or that can be determined.

It can also be seen that the gasket 9 prevents the optical lens 200 from turning solely by means of friction against the concave face 202, to the exclusion of any mechanical indexing means.

FIG. 6 shows a second embodiment of the invention. Like the support described above with reference to FIGS. 1 to 5, this support comprises a block 20 that is generally circularly symmetrical, having a reception plate 21 and a coupling sleeve 22 arranged about a common axis. The sleeve 22 is identical to the sleeve 3 of the first embodiment.

The reception plate 21 is provided with blocking means for blocking a lens (not shown) such as the lens 200 of the first example, said blocking means serving to receive the lens and to prevent it from moving by engaging its face opposite from the face that is to be surfaced. These blocking means are arranged on the top face 23 of the plate 21. However, unlike the first embodiment as described above with reference to FIGS. 1 to 5, in this second embodiment the lens needs to be blocked for the purpose of surfacing its concave face, and as a result it is necessary to hold the lens in question via its convex face. For this purpose, the reception face 23 of the plate 21 in this example is generally plane or concave.

The blocking means comprise a central cavity 24 set back from the reception face 23 and an annular gasket 25 fitted on the plate 21 and projecting from the reception face 23 thereof. The gasket 25 is in the form of a flat ring having width that is much greater than its thickness, and it possesses an inner conical collar that engages with the flank of the central cavity 24. The gasket 25 fits closely against the plane or concave shape of the reception face 23. This face thus presents no setback, with the gasket 25 projecting from said face by its entire thickness.

The blocking means further comprise abutment means arranged to form a stable and precise seat for receiving the lens. These abutment means in this example are in the form of three projecting studs 26 that are not in alignment and that form a tripod support. These three studs 26 are disposed at equal distances apart on a circle having the same axis as the block 20 and they are located adjacent to the outside edge of the gasket 25, which gasket is wedged against the stud.

Each of the three studs 26 is conical in shape and possesses a rounded top to avoid marking the lens. The tops of the three studs 26 lie in a plane perpendicular to the axis of the sleeve 22 of the block 20.

FIG. 7 shows a third embodiment of a support in accordance with the invention. As before, the support shown comprises a block 30 that is generally a body of revolution with a reception plate 31 and a coupling sleeve 32 arranged on a common axis. The sleeve 32 is identical to the sleeve 3 of the first embodiment.

The reception plate 31 is provided with blocking means for blocking a lens (not shown) such as the lens 200 of the first embodiment, said blocking means having the function of receiving and holding the lens via its face opposite from the face that is to be surfaced. These blocking means are arranged on a top face 23 of the plate 31. As in the second embodiment, and unlike the first embodiment, in this third embodiment the lens is to be blocked for the purpose of surfacing its concave face, so it is necessary to hold the lens in question via its convex face. For this purpose, the reception face 33 of the plate 31 is generally concave.

The blocking means comprise a central cavity 34 set back from the reception face 33, and an annular gasket 35 fitted on the plate 31 and covering the entire reception face 33 of the plate. The gasket 35 is in the form of a washer in relief, reminiscent of the shape of a receptacle or a hat having a plurality of concentric annular portions. Thus, in this embodiment, there can be seen four annular portions comprising: a generally conical outer annular portion 36 fitting closely on the reception face 33; an intermediate annular portion 37 that is likewise conical, having an angle at the apex that is smaller than that of the outer portion 36; a conical inner collar 38 having an even smaller angle and engaged against the flank of the central cavity 34; and a central pellet 39 that presses against the bottom of the central cavity 34. The bottom and the flank of the central cavity 34 are thus entirely covered by the gasket 35.

As in the above embodiments, the blocking means further comprise abutment means arranged to form a lens-receiving seat that is stable and precise. In this embodiment, as in the second embodiment, these abutment means are in the form of three projecting studs 40 that are not in alignment and that form a tripod support.

These three studs 40 are spaced apart at equal distances around a circle about the same axis as the block 30 and they are situated level with the intermediate annular portion 37 of the gasket 35. This intermediate portion thus presents three openings through which the three studs 40 pass, and thus project from the gasket 35 through its intermediate portion 37.

Each of the three studs 40 is conical in shape and possesses a round top to avoid marking the lens. The tops of the three studs 40 lie in a plane that is perpendicular to the axis of the sleeve 32 of the block 30.

The invention claimed is:

1. A support for pneumatically blocking an optical lens (200) on a machine or a device, the support, comprising:

blocking means for receiving and holding one face (202; 201) of the optical lens, and coupling means (3; 22; 32) for fastening the block on a corresponding member of the machine or device, said blocking means including a central cavity (8; 24; 34) and possessing a gasket (9; 25; 35) possessing at least one annular portion (9; 25; 36) against which the lens is brought to bear in order to co-operate with said cavity and said gasket to define a suction chamber (11), the blocking means comprising abutment means (10; 26; 40) arranged to provide the optical lens with a rigid seat after the gasket has deformed elastically, wherein, the abutment means and the gasket are arranged in such a way that, in order to bring the lens into abutment against the abutment means, the annular portion of the gasket comes into contact with the lens so that the gasket deforms in compression over a width of the gasket that is at least three times greater than the thickness of said annular portion of the gasket.

2. A blocking support according to claim 1, in which the gasket (9; 25; 35) prevents the optical lens from turning solely by friction against the face concerned of said lens, to the exclusion of any mechanical indexing means.

3. A blocking support according to claim 1, in which the abutment means comprise an annular bearing member (10).

4. A blocking support according to claim 3, in which the gasket (9) is in the form of a ring and the annular abutment member is constituted by a circular ridge (10) surrounding the central cavity (8), with a setback (12) being formed outside the ridge with the inside edge of the gasket (9) being engaged around the setback, said setback presenting a depth ($e_{12}$) that is perceptibly smaller than the thickness ($e_9$) of said gasket.

5. A blocking support according to claim 1, in which the abutment means comprise three spot abutment members (26; 40) that are not in alignment and form a tripod support.

6. A blocking support according to claim 5, in which the gasket (25) presents an outside edge or an inside edge that becomes wedged inside or outside the studs.

7. A blocking support according to claim 5, in which the three studs pass through corresponding openings in the gasket in order to wedge it.

8. A blocking support according to claim 1, in which, with the exception of the gasket (9; 25; 35) which is a separate and elastically-compressible part, the entire assembly and in particular the abutment means (10; 26; 40) is made as a single rigid part (1).

9. A blocking support according to claim 2, in which said annular portion (9; 25; 36) of the gasket is flat in shape.

10. A blocking support according to claim 2, in which the abutment means comprise an annular bearing member (10).

11. A blocking support according to claim 1, in which the abutment means comprise an annular bearing member (10).

12. A blocking support according to claim 2, in which the abutment means comprise three spot abutment members (26; 40) that are not in alignment and form a tripod support.

13. A blocking support according to claim 1, in which the abutment means comprise three spot abutment members (26; 40) that are not in alignment and form a tripod support.

14. A support for pneumatically blocking an optical lens (200), the support, comprising:

a plate (2) for receiving the lens (200) that is to be blocked, the plate including a top face (7) and a central cavity (8);

a coupling (3) projecting from the plate, the coupling (3) for securing the support to a machine tool or a measurement device;

a setback (12) located on the top face (7) of the plate (2) and extending outwardly to an outermost periphery of the plate (9);

a gasket having an annular portion (9) with an inside edge of the gasket (9) engaged against an edge of the setback, the lens, when blocked, being in contact against the annular portion of the gasket in order to co-operate with said cavity and said gasket to define a suction chamber (11); and abutment elements (10; 26; 40) arranged to provide the lens with a rigid seat with the gasket deformed elastically in compression, with the lens blocked, the annular portion (9) of the gasket being a flat ring deformed in compression and having a radial width (19) at least three times greater than a thickness (e9) of the annular portion (9) with an entire lower surface of the annular portion in contact with the setback and an entire upper surface of the annular portion in contact with the lens.

15. A blocking support according to claim 14, wherein, a height (e12) of the setback (12) is less than the thickness (e9) of the annular portion (9) of the gasket.

* * * * *